US006216889B1

(12) United States Patent
Chang

(10) Patent No.: US 6,216,889 B1
(45) Date of Patent: Apr. 17, 2001

(54) ROD RACK SUPPORTING STRUCTURE

(76) Inventor: Tien-Tsai Chang, No. 18, Lane 1281, Chung Cheng Road, Wu Fong Hsiang, Taichung Hsien (TW)

( * ) Notice: Subject to any disclaimer, the term of this patent is extended or adjusted under 35 U.S.C. 154(b) by 0 days.

(21) Appl. No.: 09/492,873

(22) Filed: Jan. 26, 2000

(51) Int. Cl.[7] ..... A47F 5/00

(52) U.S. Cl. ..... 211/105.1; 211/123; 248/316.6; 248/74.4; 248/262; 248/263

(58) Field of Search ..... 211/105.1, 123; 248/251, 261, 262, 263, 264, 74.4, 316.6

(56) References Cited

U.S. PATENT DOCUMENTS 356,741 * 2/1887 Beckman .
758,419 * 4/1904 Cooke .
869,328 * 10/1907 Pearson .
928,190 * 7/1909 Flynn .
983,347 * 2/1911 Buschor .
1,203,765 * 11/1916 Miller .
3,095,033 * 6/1963 Polkosnik .
4,283,035 * 8/1981 Oiembarrena et al. ..... 248/265 X
5,395,079 * 3/1995 Jensen et al. ..... 248/74.4
5,605,309 * 2/1997 Nadherny ..... 248/74.4 X

* cited by examiner

*Primary Examiner*—Robert W. Gibson, Jr.
(74) *Attorney, Agent, or Firm*—W. Wayne Liauh

(57) ABSTRACT

A rod rack supporting structure comprises two support frames, a rod, and two locating members. The support frames are provided with a cross rod which is in turn provided with a plurality of retainers for retaining the rod. The retainers are provided in both plate surfaces of the opening thereof with a slide block. The locating members are provided in the inner side thereof with an arcuate slot and a slide slot corresponding to the slide block. The rod rack is securely located by the two slide blocks which are engaged with the two slide slots.

4 Claims, 11 Drawing Sheets

D—D

C—C

ROD RACK SUPPORTING STRUCTURE

FIELD OF THE INVENTION

The present invention relates to a rod rack supporting structure.

BACKGROUND OF THE INVENTION

As shown in FIGS. 1 and 2, a support frame 1 of the prior art is provided in the vertical plate thereof with a through hole 2 for receiving a bolt, and in the horizontal plate thereof with with an arcuate slot 3 for locating a blind holding rod 4. The support frame 1 is further provided in an outer side plate 31 thereof with a through hole 32 for engaging a locating bolt 5. The blind holding rod is vulnerable to damage by the locating bolt. When the locating bolt is exerted on by an external force, the outer side plate is susceptible to deformation. As a result, the support frame is incapable of supporting securely the holding rod.

As shown in FIGS. 3 and 4, a prior art support frame 6 is provided in the vertical plate thereof with a hole 7 for receiving a bolt, and in the horizontal plate thereof with a retainer 8 for retaining a bathroom rod 9 in conjunction with a plate surface 81. The retainer is not structurally strong to withstand an external force exerting thereon.

SUMMARY OF THE INVENTION

The primary objective of the present invention is to provide a rod rack supporting structure which is free from the drawbacks of the prior art support structures described above.

In keeping with the principle of the present invention, the foregoing objective of the present invention is attained by a rod rack supporting structure comprising two support frames, a rod, and two locating members. The support frames are provided with a cross rod which is in turn provided with a plurality of retainers for retaining the rod. The retainers are provided in both plate surfaces of the open end thereof with a slide block. The locating members are provided in the inner side thereof with an arcuate slot and a slide slot corresponding to the slide block. The rod rack is securely located by the two slide blocks which are inserted into the two slide slots.

The arcuate slot and the two slide slots of the locating member have a front end which is gradually thickened toward the rear end so as to form an inclined inner surface. When the locating member is engaged with the retainer, the rod rack is urged by the inclined inner surface. The slide block is provided with a position confining block in cooperation with a recess of the slide slot, thereby preventing the locating member to move about.

BRIEF DESCRIPTION OF THE DRAWINGS

FIG. 9-1 shows a sectional view taken along the direction C—C as shown in FIG. 8.

FIG. 9-2 shows a sectional view taken along the direction D—D as shown in FIG. 8.

DETAILED DESCRIPTION OF THE INVENTION

Figure 5:
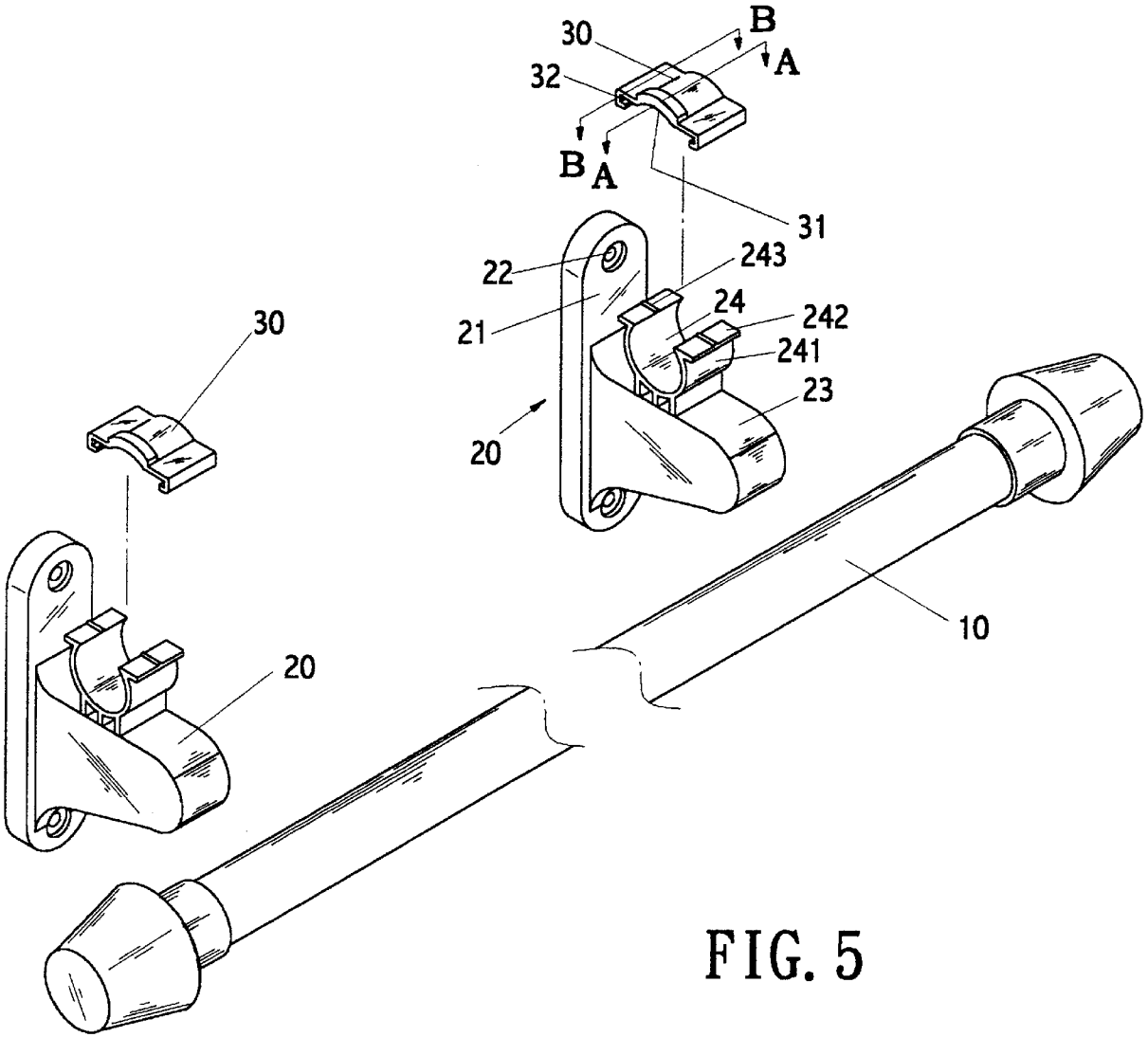
FIG. 5 shows an exploded view of the present invention.
Figure 7:
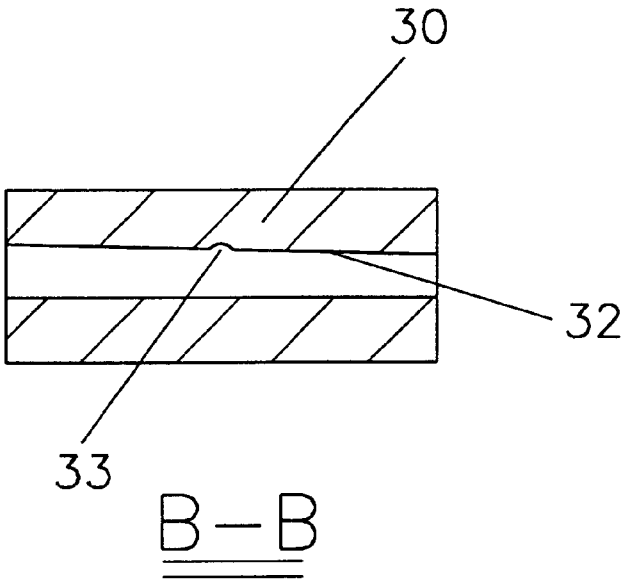
FIG. 7 shows a sectional view of a portion taken along the direction indicated by a line B—B as shown in FIG. 5.
Figure 6:
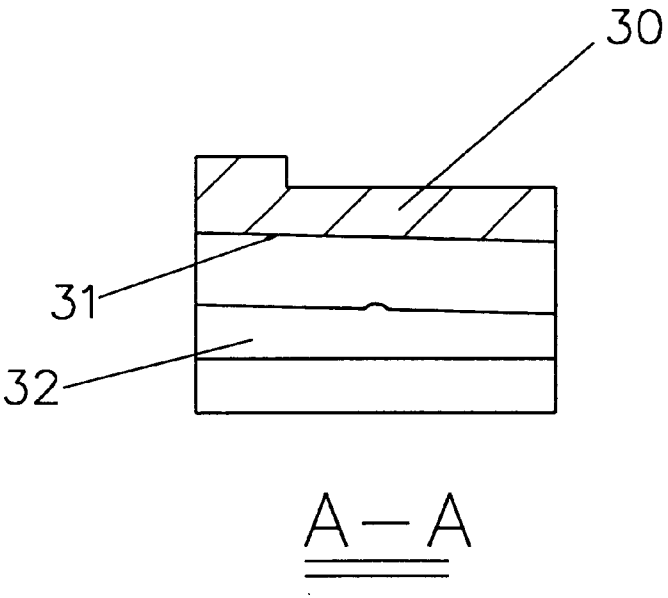
FIG. 6 shows a sectional view of a portion taken along the direction indicated by a line A—A as shown in FIG. 5.

As shown in FIGS. 5–7, the present invention comprises: A rod 10.

Two support frames 20 having a locating plate 21 with a plurality of holes 22. The locating plate 21 is provided with a cross member 23 provided with retainer 24 having a plurality of openings facing upward. The width of the opening of the retainer 24 is slightly smaller than the diameter of the rod 10 so as to enable the rod 10 to be retained therein. The two side plates 241 of the retainer 24 are each provided at the top thereof with a wing plate 242 which is provided with a position confining block 243 in the form of a transversely disposed ridge;

Two locating members 30. The locating members 30 are provided in the middle of the inner surface with an arcuate cover 31. The front end of the inner surface of the arcuate cover 31 is thickened toward the rear end. The arcuate cover 31 thus has an inclined plane, as shown in FIG. 6. The arcuate cover 31 is provided in both sides thereof with a receiving groove 32 corresponding to the wing plate 242 of the support frame 20. The receiving groove 32 is similar in construction to the arcuate cover 31, as shown in FIG. 7. The receiving groove 32 is provided with a recess 33 corresponding to the position confining block 243 of the retainer 24.

Figure 1:
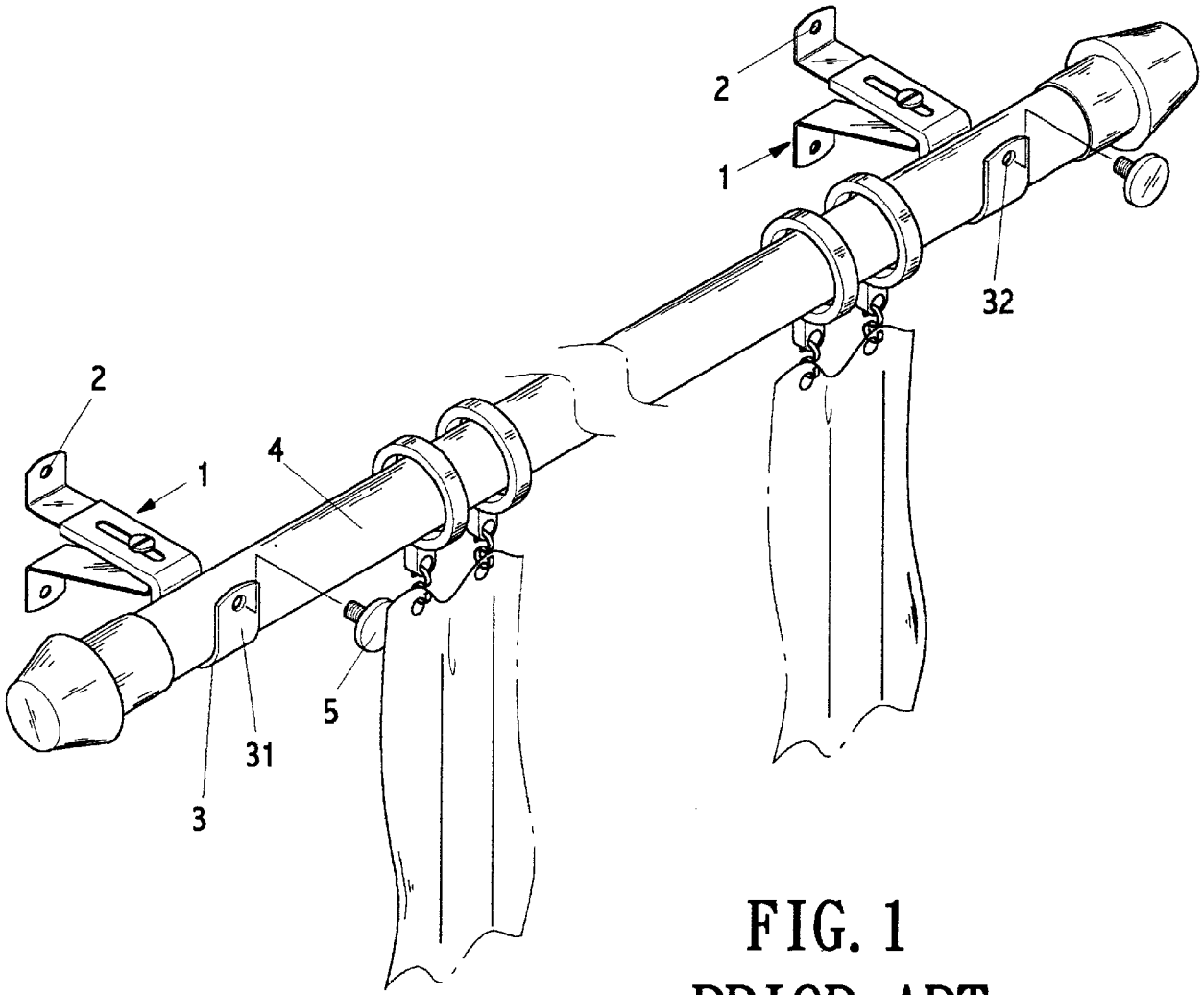
FIG. 1 PRIOR ART
FIG. 1 shows an exploded view of a support frame of the prior art.
Figure 2:
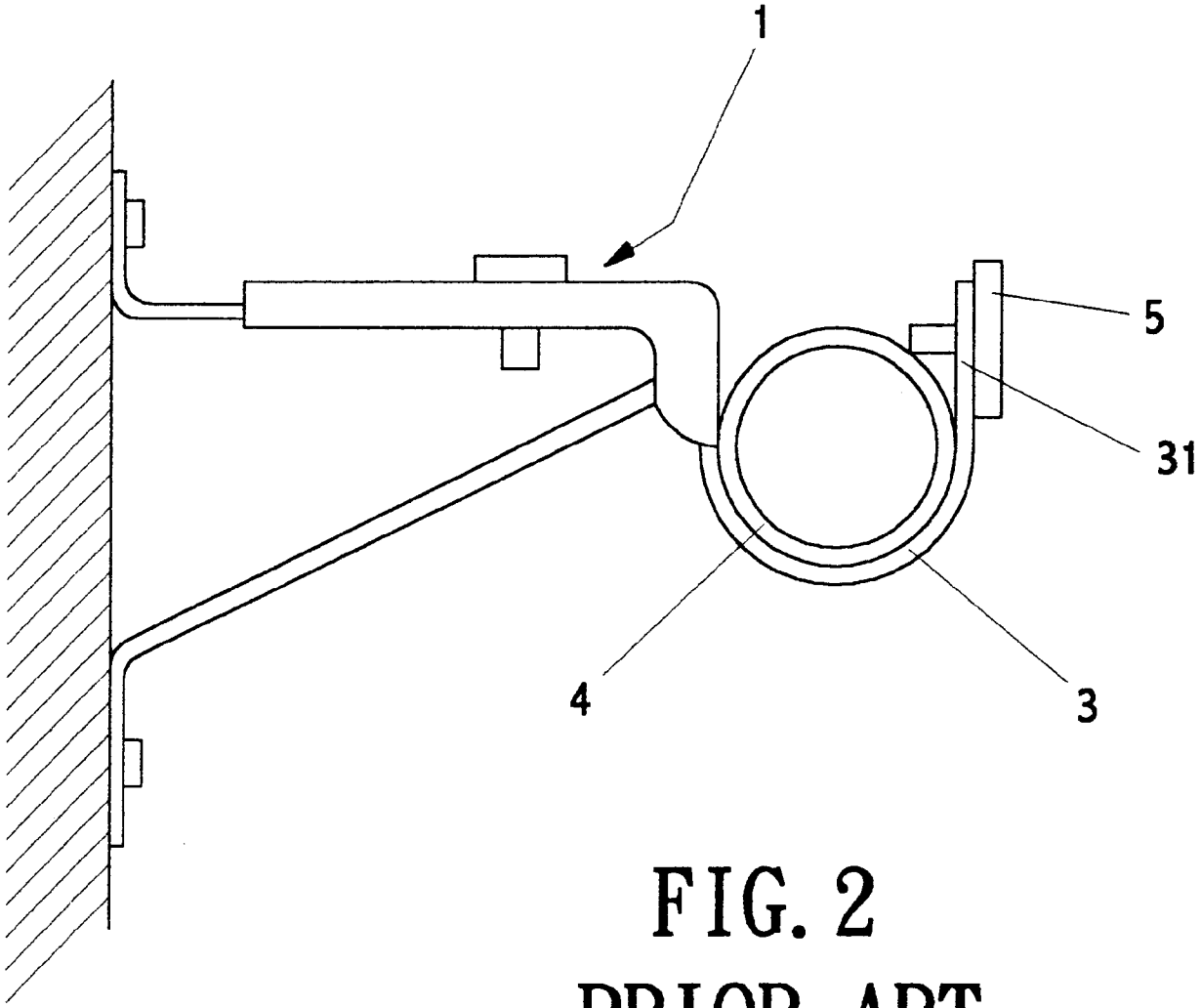
FIG. 2 PRIOR ART
FIG. 2 shows a schematic view of the prior art support frame in combination.
Figure 3:
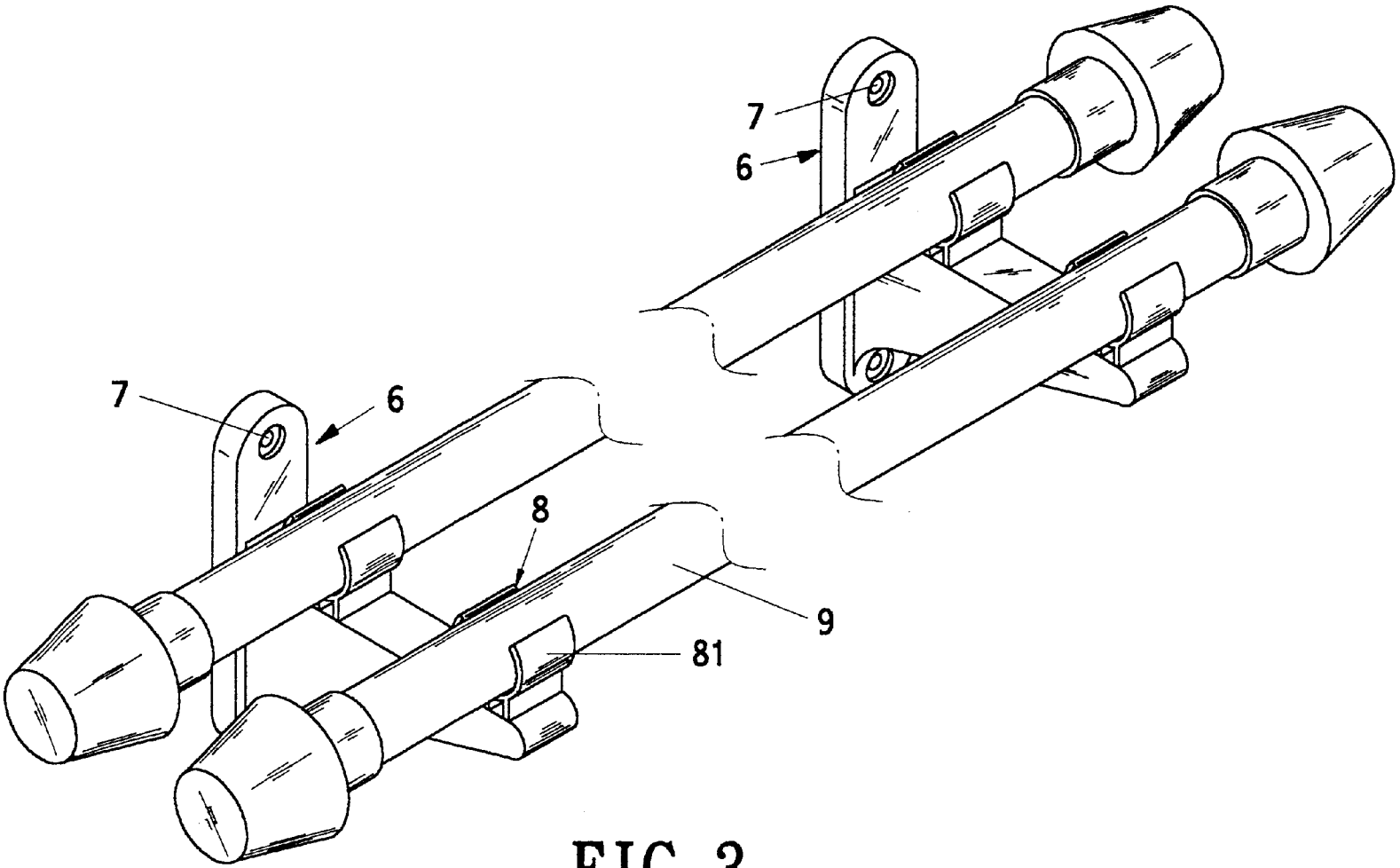
FIG. 3 PRIOR ART
FIG. 3 shows a perspective view of a support frame of another prior art.
Figure 4:
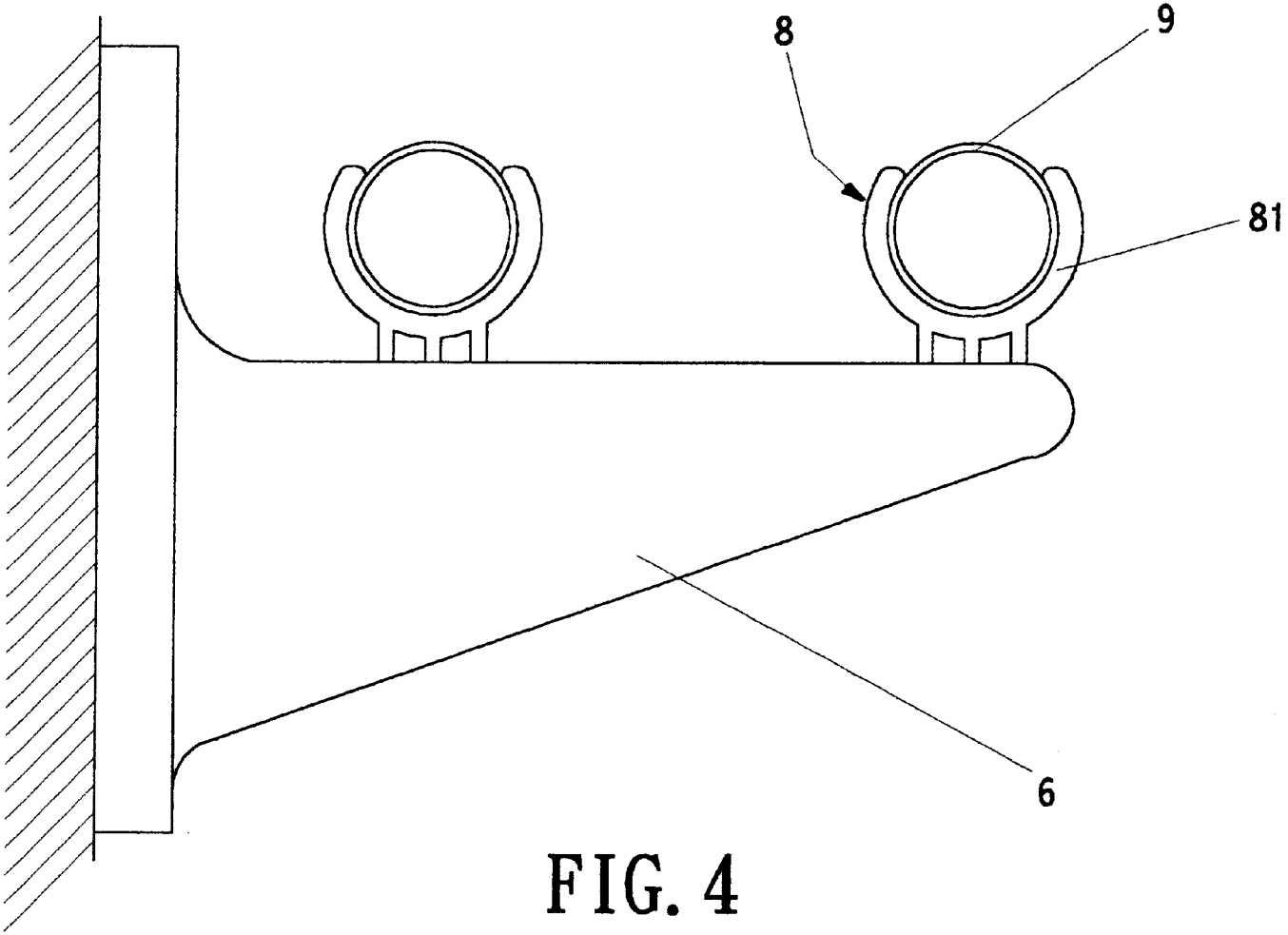
FIG. 4 PRIOR ART
FIG. 4 shows a schematic view of the prior art as shown in FIG. 3.
Figure 8:
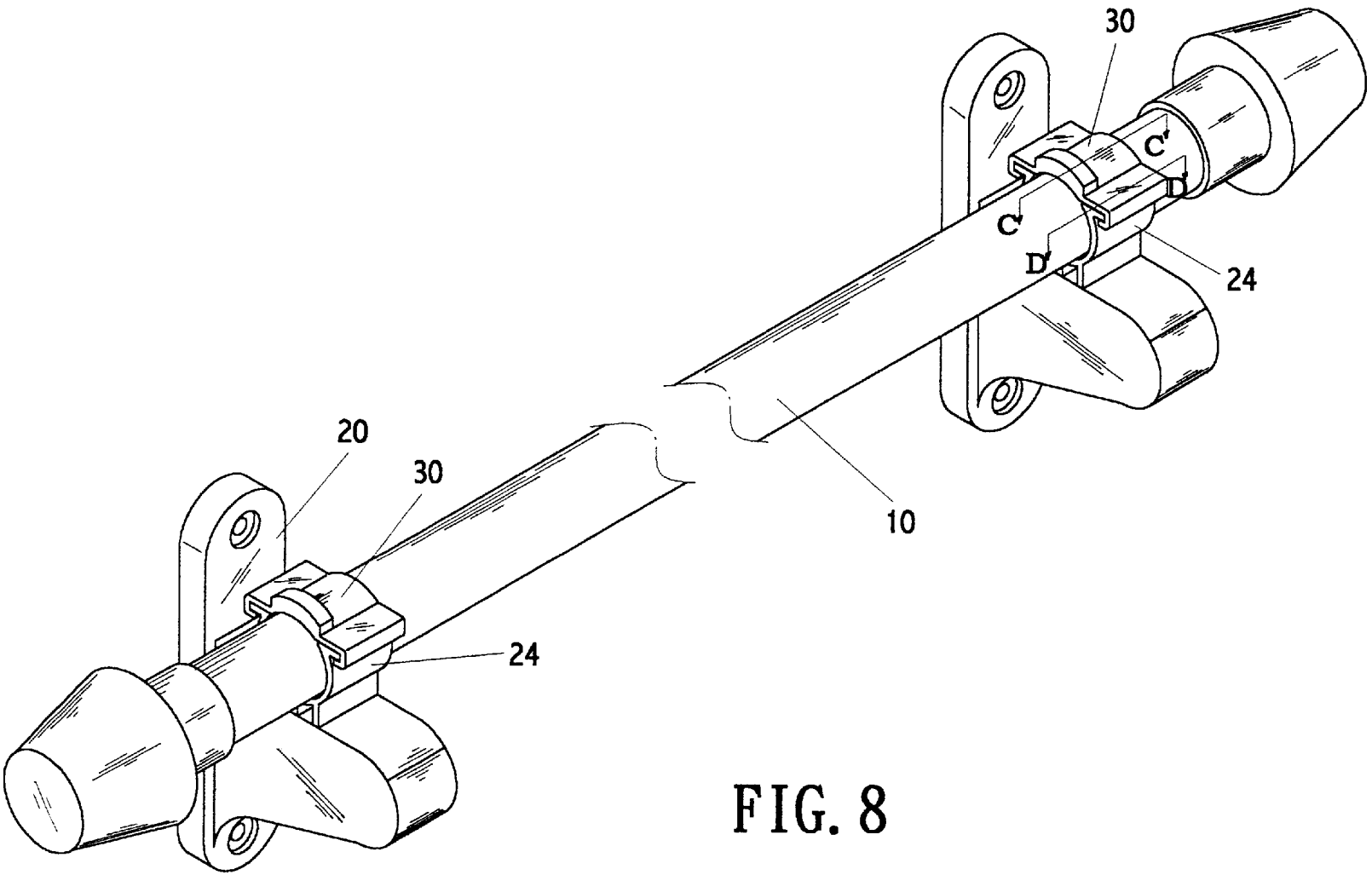
FIG. 8 shows a schematic view of the present invention in combination.
Figures 2, 9:
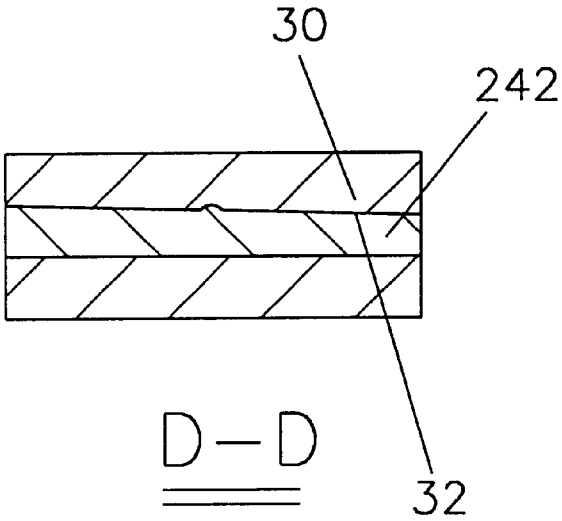
Figures 1, 9:
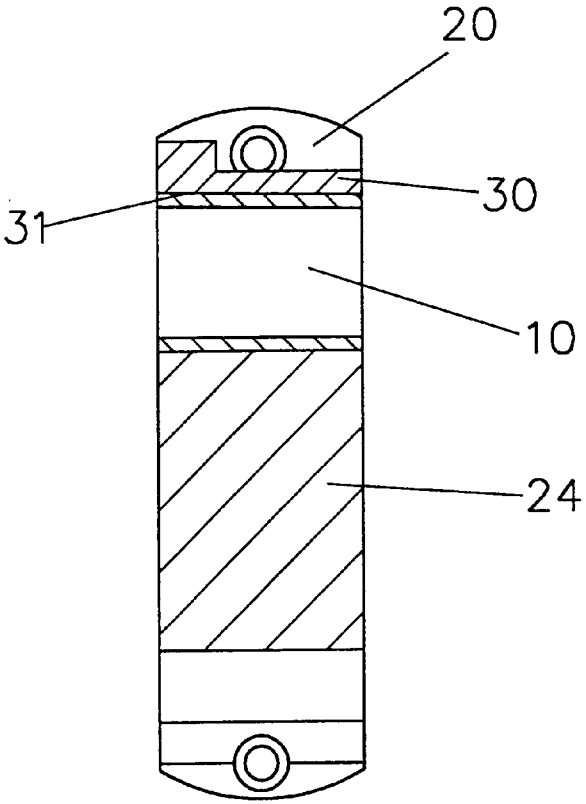

As shown in FIGS. 8–9-2, the rod 10 is retained in the retainer 24 of the support frame 20 such that the wing plate 242 of the retainer 24 are retained in the receiving groove 32 of the locating member 30, and that the inclined plane of the receiving groove 32 urges the wing plate 242, and further that the recess 33 is engaged with the position confining block 243 of the wing plate 242. The inclined plane of the arcuate cover 31 of the locating member 30 urges the rod 10.

Figure 10:
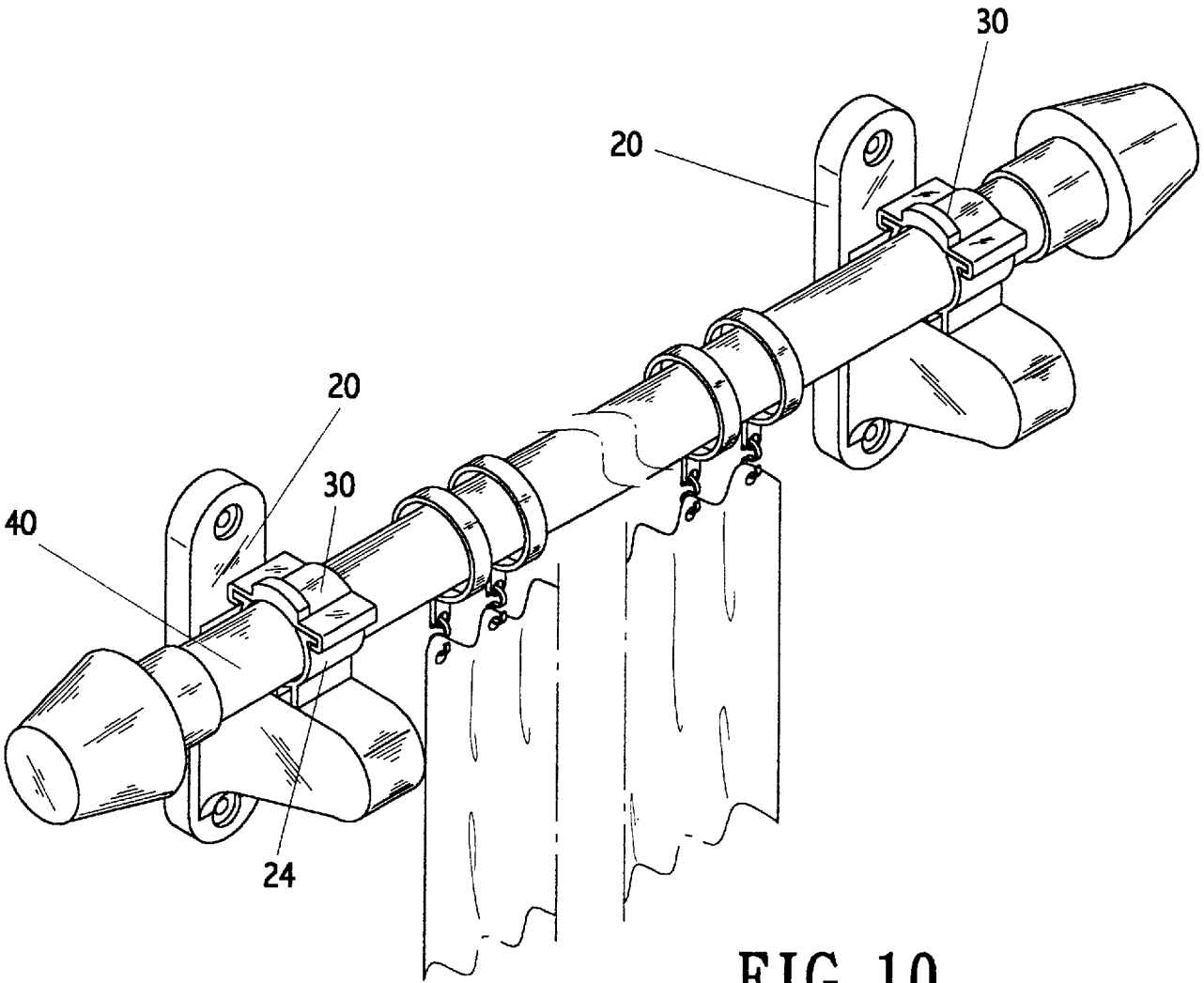
FIG. 10 shows a schematic view of the present invention in use for supporting a window blind rod.

As shown in FIG. 10 in conjunction with FIGS. 5–7, the present invention is used to support the window blind rod. The retainer 24 of the support frames 20 holds a rod 40 securely such that the receiving groove 32 of the locating member 30 are engaged with the wing plate 242 of the two side plates 241 of the retainer 24. In addition, the inclined planes of the receiving groove 32 and the arcuate cover 31 urge intimately the wing plate 242 and the rod 40. Moreover, the recess 33 of the receiving groove 32 is engaged with the position confining block 243 of the wing plate 242. The rod 40 is thus held securely by the support frames 20 in conjunction with the locating members 30.

Figure 11:
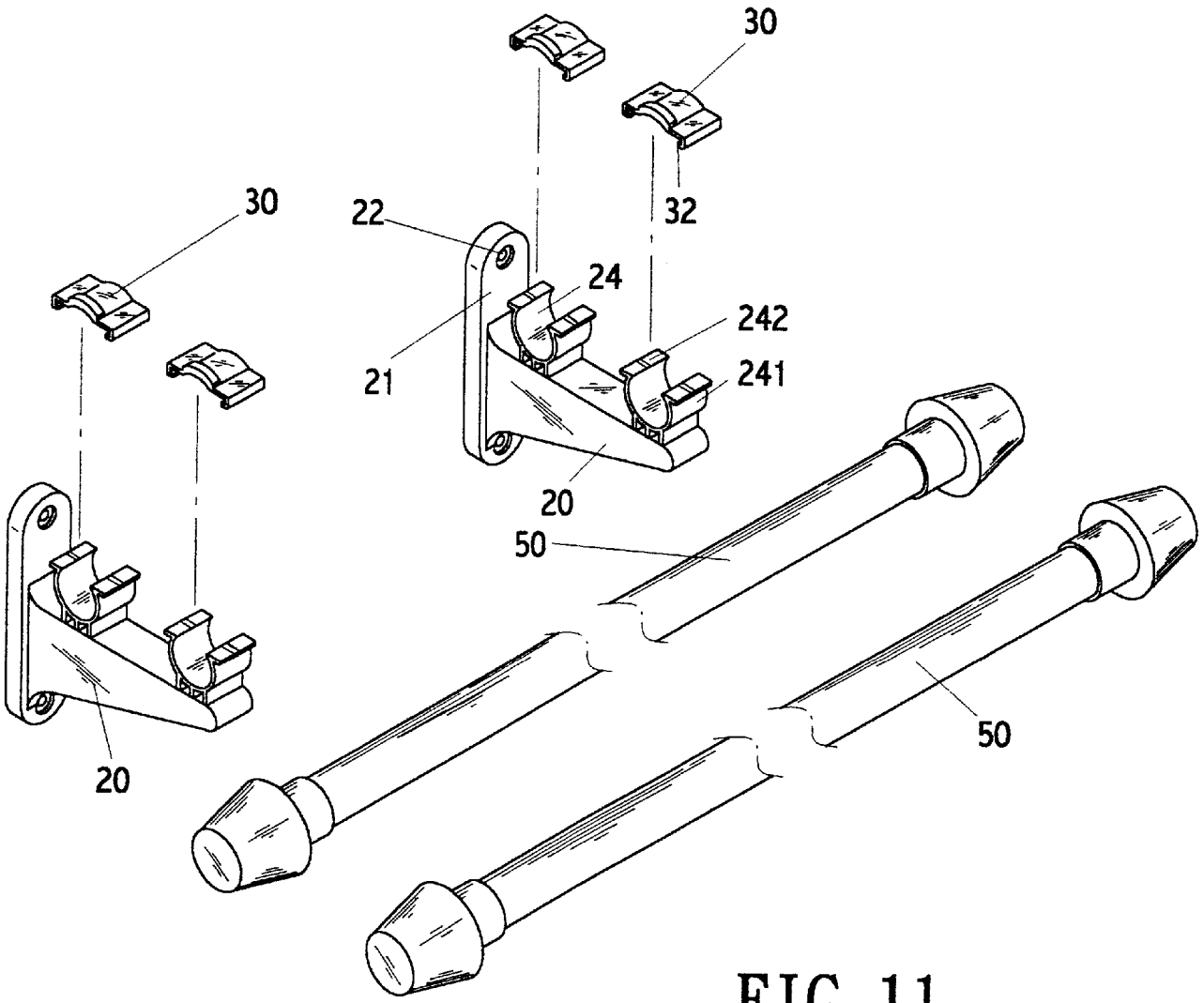
FIG. 11 shows a schematic view of the present invention in use for supporting a bathroom rod rack.
Figure 12:
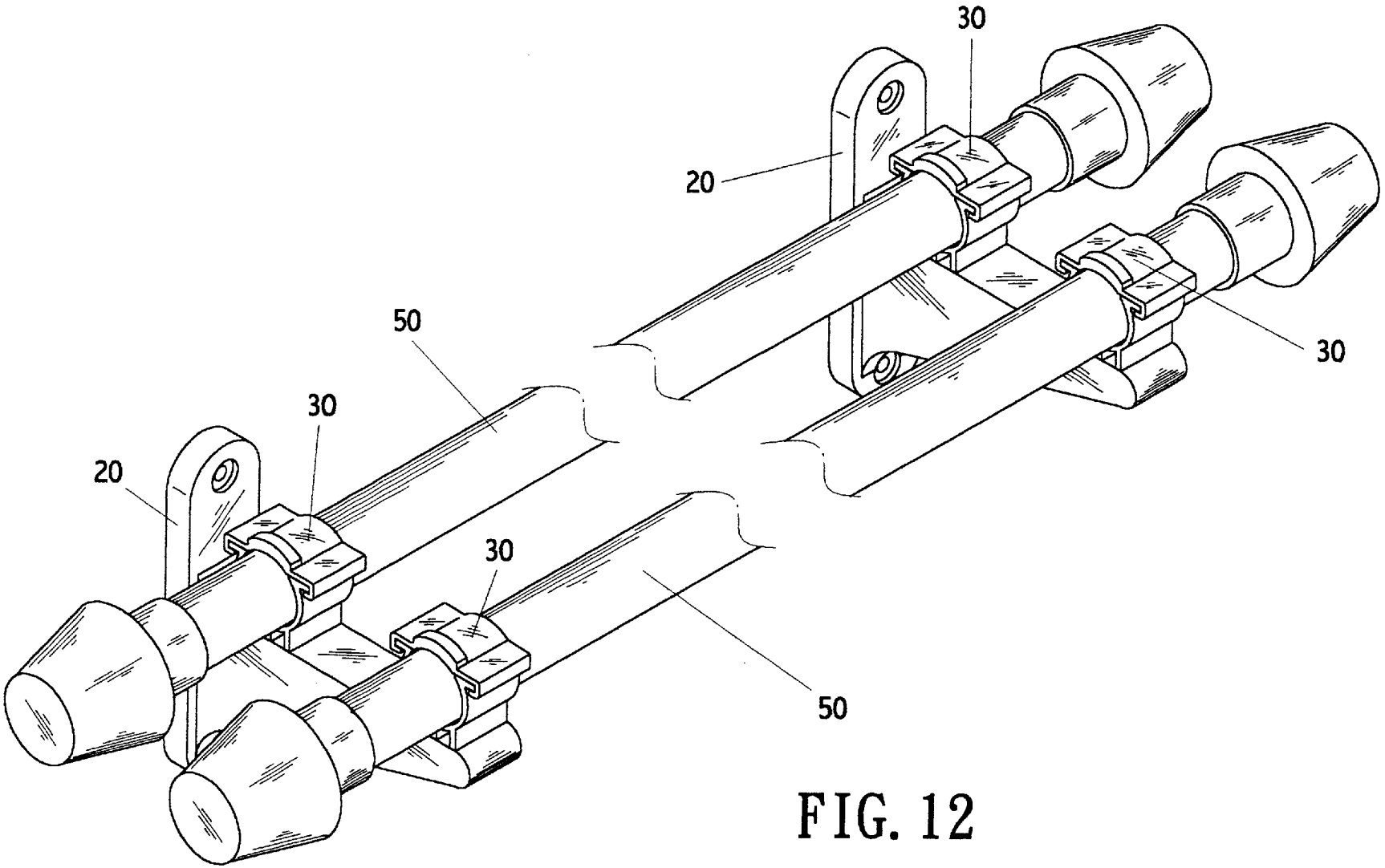
FIG. 12 shows another schematic view of the present invention in use for supporting a bathroom rod rack.

As shown in FIGS. 11 and 12, in conjunction with FIGS. 5–7, the support frames 20 are fastened onto the bathroom wall by a plurality of fastening bolts which are received in the through holes 22 of the locating plates 21. A rod rack 50 is held securely by the retainers 24 of the support frames 20 in conjunction with the locating members 30. The receiving groove 32 of the locating members 30 are engaged with the wing plate 242 of the two side plates 241 of the retainers 24. The rod rack 50 is intimately urged by the inclined planes of the receiving groove 32 and the arcuate cover 31.

What is claimed is:

1. A rod rack supporting structure comprising:

(a) a plurality of support frames each having:

(i) a locating plate for mounting said support frame, and (ii) a cross member extending from said locating plate, said cross member containing a retainer for receiving a rod, said retainer containing a pair of side plates and a pair of wing plates disposed on top of said side plates, respectively, said wing plate containing a position confining protrusion in the form of a transversely disposed ridge;

(b) a plurality of locating members for affixing a rod to said cross members, each having:

(i) an arcuate cover, and (ii) a pair of receiving grooves at both sides of said arcuate cover for receiving said wing plates, respectively, each of said receiving grooves having a recess on a top inner surface of said receiving groove for receiving a corresponding position confining protrusion.

2. The rod rack supporting structure according to claim 1 wherein said arcuate cover has a varying thickness which decreasing from one end to another to form an inclined surface.

3. The rod rack supporting structure according to claim 1 wherein said receiving groove has a varying thickness which decreasing from one end to another to form an inclined surface.

4. The rod rack supporting structure according to claim 1 wherein both said arcuate cover and said receiving groove have a varying thickness which decreasing from one end to another to form an inclined surface.

* * * * *